US010792531B1

(12) United States Patent
Haley

(10) Patent No.: US 10,792,531 B1
(45) Date of Patent: Oct. 6, 2020

(54) RESISTANCE TRAINING EXERCISE MACHINES HAVING INERTIAL SWITCH-ACTUATED DAMPENING DEVICE

(71) Applicant: Brunswick Corporation, Mettawa, IL (US)

(72) Inventor: Charles A. Haley, Rochester, MN (US)

(73) Assignee: Life Fitness, LLC, Rosemont, IL (US)

( * ) Notice: Subject to any disclaimer, the term of this patent is extended or adjusted under 35 U.S.C. 154(b) by 88 days.

(21) Appl. No.: 15/960,976

(22) Filed: Apr. 24, 2018

(51) Int. Cl.

| | |
|---|---|
| ***A63B 21/00*** | (2006.01) |
| ***A63B 21/04*** | (2006.01) |
| ***A63B 21/008*** | (2006.01) |
| ***A63B 21/02*** | (2006.01) |

(52) U.S. Cl.
CPC ..... *A63B 21/155* (2013.01); *A63B 21/0087* (2013.01); *A63B 21/021* (2015.10); *A63B 21/025* (2013.01); *A63B 21/0435* (2013.01); *A63B 21/156* (2013.01); *A63B 21/157* (2013.01)

(58) Field of Classification Search
CPC ..... A63B 21/00058; A63B 21/00065; A63B 21/00076; A63B 21/008–0557; A63B 21/0624; A63B 21/0628; A63B 21/063; A63B 21/155; A63B 21/156; A63B 21/22; A63B 21/222; A63B 71/0054; A63B 2071/0063; A63B 2071/0072; A63B 2071/0081; E05B 77/06; E05B 77/42; F16F 15/13128; F16F 15/12353; F16F 9/504
See application file for complete search history.

(56) References Cited

U.S. PATENT DOCUMENTS

| | | | | |
|---|---|---|---|---|
| 4,666,149 | A * | 5/1987 | Olschansky ..... | A63B 21/00072 482/130 |
| 4,934,660 | A * | 6/1990 | Nelson ..... | B66D 3/10 182/239 |
| 7,335,139 | B2 | 2/2008 | Bartholomew et al. | |
| 7,413,532 | B1 | 8/2008 | Monsrud et al. | |
| 7,597,653 | B1 | 10/2009 | Lindemeier | |
| 7,789,812 | B2 * | 9/2010 | Anderson ..... | A63B 7/04 482/95 |
| 7,887,468 | B2 | 2/2011 | Ross et al. | |
| 7,981,014 | B2 | 7/2011 | Ross et al. | |
| 8,968,167 | B1 | 3/2015 | Abelbeck et al. | |

* cited by examiner

*Primary Examiner* — Loan B Jimenez
*Assistant Examiner* — Kathleen Vermillera
(74) *Attorney, Agent, or Firm* — Andrus Intellectual Property Law, LLP

(57) ABSTRACT

An exercise machine has a resistance mechanism that is movable with respect to a stationary frame into and between a rest position and an active position and a pulley system coupled to the resistance mechanism and being operable by a user performing an exercise motion. Operation of the pulley system moves the resistance mechanism from the rest position to the active position, against a resistance force from the resistance mechanism. Releasing the pulley system allows the resistance force to automatically move the resistance mechanism back towards the rest position. A dampening device has an inertial switch that causes the dampening device to automatically dampen movement of the resistance mechanism from the active position towards the rest position when the pulley system is suddenly released.

16 Claims, 13 Drawing Sheets

RESISTANCE TRAINING EXERCISE MACHINES HAVING INERTIAL SWITCH-ACTUATED DAMPENING DEVICE

FIELD

The present disclosure relates to exercise machines and more particularly to resistance-type machines for weight training.

BACKGROUND

The following U.S. Patents are incorporated herein by reference:

U.S. Pat. No. 8,968,167 discloses a resistance system for an exercise device including a plurality of cord plates which may be selectively engaged by one or more pins which may include an engagement lock. One or more of the cord plates may be received by a pin with each cord plate that is received by a pin being secured relative to a frame. A cord plate that has received a pin is engaged and a cord plate that is not received by a pin is disengaged. A carriage may be provided which receives a plurality of elastic cords which may be attached to the cord plates. The carriage may be displaced relative to a base frame, to provide elongation of the elastic cords coupled to engaged cord plates and no elongation of the cords coupled to the disengaged cord plates which provide a selective resistance for a user.

U.S. Pat. No. 7,981,014 discloses a resistance system for an exercise device including a frame, a resistance element such as elastic bands, coil springs, weight plates, pneumatic or hydraulic cylinders. An interference element such as a plate, chain or one or more links is supported by a support plate mounted on the frame. Selective engagement with the resistance element is provided by actuation of a dial, other actuator or controller or directly by the user. Thereby the resistance element can be selectively engaged or disengaged to vary the resistance to the user.

U.S. Pat. No. 7,887,468 discloses a resistance system for fitness equipment including a frame, a resistance source such as an elastic cord, coil or any other type of spring, weight, pneumatic or hydraulic cylinders. The resistance source is mounted to a resistance block with a load support. A support disk is provided that is movably mounted to the frame and adapted to enable selective engagement with the load support. A transmission member, including a pliable member such as a cable, belt or other member, is coupled to the resistance source. Movement of the support disk enables selective engagement of the resistance source. In this way one or more individual resistance sources can be selectively engaged or disengaged to vary the resistance to the user by actuation of a dial or other actuator as directed by the user.

U.S. Pat. No. 7,597,653 discloses an exercise apparatus having a rotary camming disc selectively configured to engage respective locking pins for engaging and disengaging selective numbers of force resistors for varying exercise resistance.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter. In certain examples disclosed herein, an exercise machine has a resistance mechanism that is movable with respect to a stationary frame into and between a rest position and an active position and a pulley system coupled to the resistance mechanism and being operable by a user performing an exercise motion. Operation of the pulley system moves the resistance mechanism from the rest position to the active position, against a resistance force from the resistance mechanism. Releasing the pulley system allows the resistance force to automatically move the resistance mechanism back towards the rest position. A dampening device has an inertial switch that causes the dampening device to automatically dampen movement of the resistance mechanism from the active position towards the rest position when the pulley system is suddenly released.

DETAILED DESCRIPTION OF THE DRAWINGS

Figure 1:
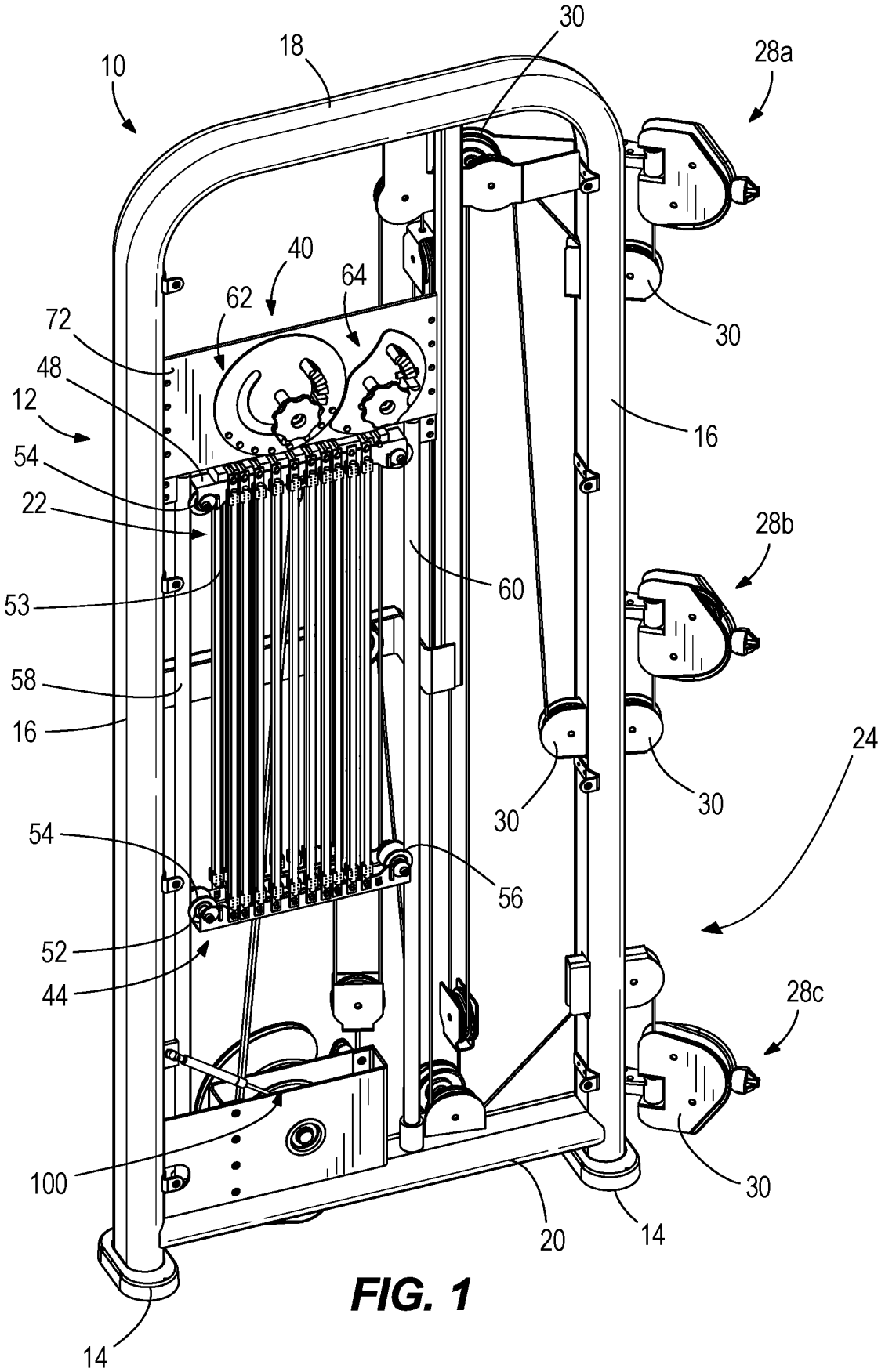
FIG. 1 is a front perspective view of an exercise machine having a resistance mechanism for resisting an exercise motion performed with respect to the machine.
Figure 2:
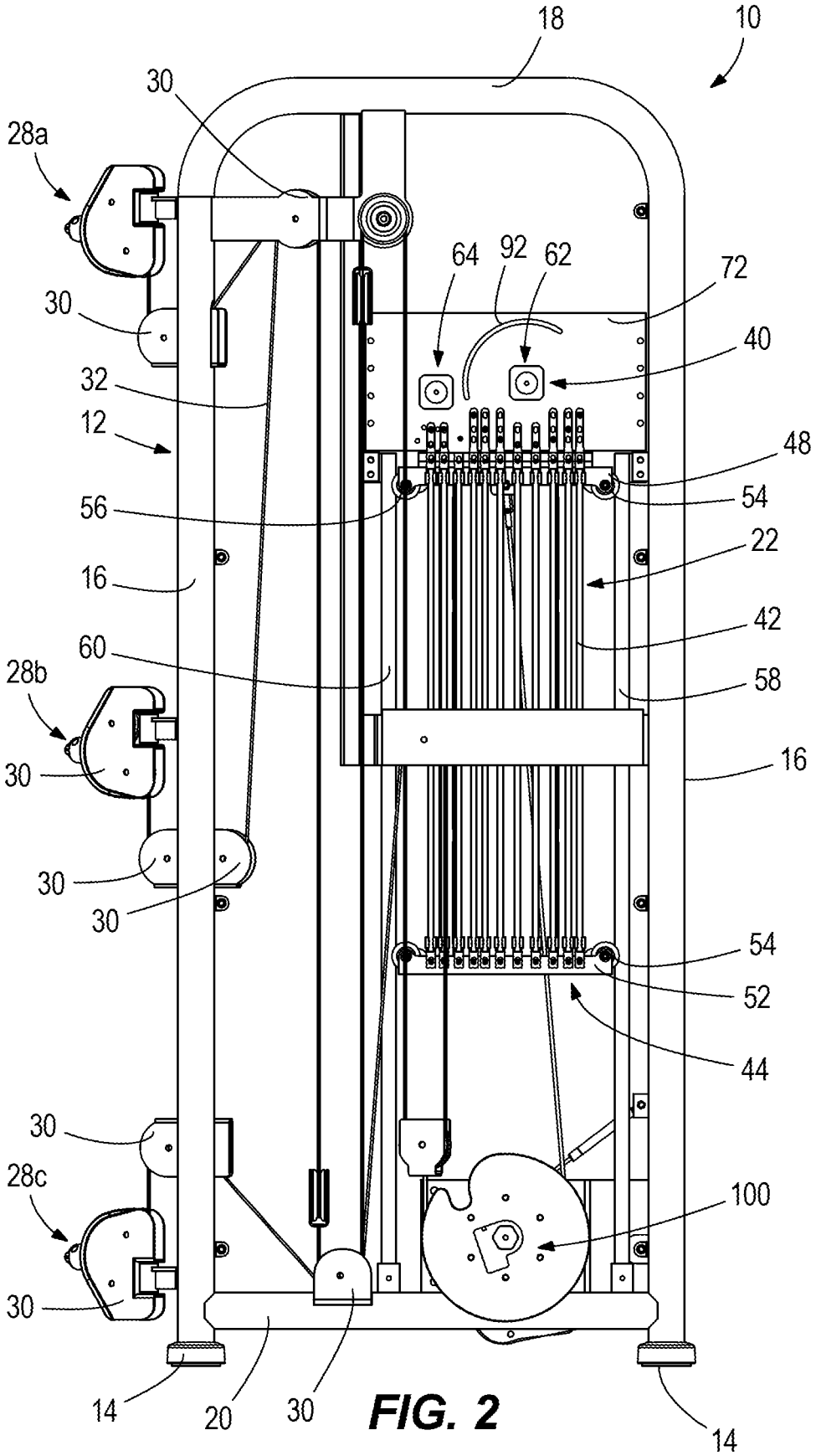
FIG. 2 is a rear view of the exercise machine.

FIGS. 1-4 depict an exercise machine 10 configured like the exercise machine disclosed in U.S. patent application Ser. No. 15/889,386 filed Feb. 6, 2018, which is incorporated herein by reference. The exercise machine 10 includes a supporting frame 12 having a pair of ground-engaging feet 14, a pair of support columns 16 that extend upwardly from the ground-engaging feet 14, and top and bottom cross beams 18, 20 that extend between the support columns 16. A resistance mechanism 22 is supported on the supporting frame 12. The exact configuration of the resistance mechanism 22 can vary from what is shown, and can alternately be, for example, configured similar to one or more of the arrangements that are described in the above-incorporated U.S. Patents. In the illustrated example, a plurality of elastic resistance members 42 (e.g., bands) provide resistance to an exercise motion being performed by a user. A pulley system 24 is also supported on the supporting frame 12 and is coupled to the resistance mechanism 22 such that the resistance mechanism 22 resists operation of the pulley system 24 during the exercise motion. The pulley system 24 has pulley cables 32 that have one or more first ends 26 connected to the resistance mechanism 22 and one or more opposite, second end 28*a*, 28*b*, 28*c* configured for engagement and operation (e.g., pulling and then releasing) by a user performing an exercise motion with respect to the exercise machine 10. The exercise machine 10 further includes a selector mechanism 40 that is operable by the user to adjust an amount of resistance provided by the resistance mechanism 22 to operation of the pulley system 24 prior to initiation of the exercise motion. The selector mechanism 40 is supported on a cross panel 72 that extends between the support columns 16 above the resistance mechanism 22.

The resistance mechanism 22, pulley system 24, and selector mechanism 40 will now be further described; however it should be recognized that these are merely examples and the particular configuration of these components can vary widely from what is shown and described. Other suitable examples are provided in the above-incorporated U.S. Patents.

Referring to FIGS. 1-4, the resistance mechanism 22 includes a plurality of elastic resistance members 42 that are supported on a carriage 44. The carriage 44 has an upper carriage member 48 and a lower carriage member 52 that are movable together along the supporting frame 12. More specifically, each elastic resistance member 42 has an upper end that is supported on the upper carriage member 48, a lower end that is supported on the lower carriage member 52, and a pair of elongated elastic bodies that extend between the upper and lower ends and that are disposed on opposite sides of the carriage 44, respectively. The elongated elastic bodies are made of a stretchable elastic material, such as a rubber, which has a natural resiliency so that it tends to maintain its length shown in FIG. 1. The upper and lower carriage members 48, 52 each extend generally horizontally with respect to the supporting frame 12 and have opposing roller wheels 54, 56 that roll along the surface of vertical bars 58, 60 disposed on opposite sides of the carriage 44. As explained further herein below, operation of the pulley system 24 (e.g., by pulling on one or more of the second ends 28*a*, 28*b*, 28*c*) pulls the carriage 44 downwardly, as facilitated by rolling of the opposing roller wheels 54, 56 along the vertical bars 58, 60. The elastic resistance members 42 that are engaged by the selector mechanism 40 (as will be described further herein below) have a natural resiliency that resists downward movement of the carriage 44 and biases the upper and lower carriage members 48, 52 back upwardly, such that the carriage 44 moves back upwardly along the vertical bars 58, 60 for example when the pulley system 24 is released by the user.

The elastic resistance members 42 are fixed in place with respect to the lower carriage member 52 via, for example, one or more fasteners that are engaged with lower end brackets on the elongated elastic bodies. The elastic resistance members 42 are movably supported with respect to the upper carriage member 48 by a cross-pin 55 (see FIG. 4) that connects upper end brackets 57 on the elongated elastic bodies 53. When the resistance mechanism is at rest (see FIG. 4), the natural resiliency of the elongated elastic bodies 53 causes the cross-pin 55 to seat in a corresponding recess formed in the upper carriage member 48. When the pulley system 24 is operated, the carriage 44 (including upper carriage member 48 and lower carriage member 52) is pulled downwardly with respect to any elastic resistance members 42 that are engaged with the selector mechanism 40. Downward movement of the carriage 44 with respect to the elastic resistance members 42 that are engaged with the selector mechanism 40 stretches the elastic resistance members 42, which thereby apply a resistance force on the pulley system 24. The remaining elastic resistance members 42 that are not engaged with the selector mechanism 40 are simply carried downwardly along with the carriage 44. See the above-incorporated U.S. patents for more description of this type of resistance mechanism.

In the illustrated example, the pulley system 24 includes several pulley wheels 30 that are coupled to the supporting frame 12. The pulley system 24 further includes the pulley cable 32 having the first end 26 coupled to the resistance mechanism 22 and the opposite, second ends 28*a*, 28*b*, 28*c* which are configured for attachment to a user operable member, such as a handle, bar, rope, etc. (not shown). The pulley cable 32 extends around the various pulley wheels 30 and is configured such that pulling on one or more of the second end 28*a*, 28*b*, 28*c* pulls the pulley cable 32 about the pulley wheels 30 and pulls downwardly on the carriage 44 via its connection to the upper carriage member 52 at the first end 26. The number and location of the pulley wheels 30 and the configuration of the pulley cable 32 and its attachment to the carriage 44 is not essential and can vary from what is shown, as long as operation of the pulley system 24 causes movement of the carriage 44. As is conventional, the pulley cable 32 is also routed around a cam 100 located below the carriage 44. Pulling on the pulley cable 32 rotates the cam 100, which in turn determines a resistance force profile provided to the operator during the exercise motion, all as is conventional.

Figure 3:
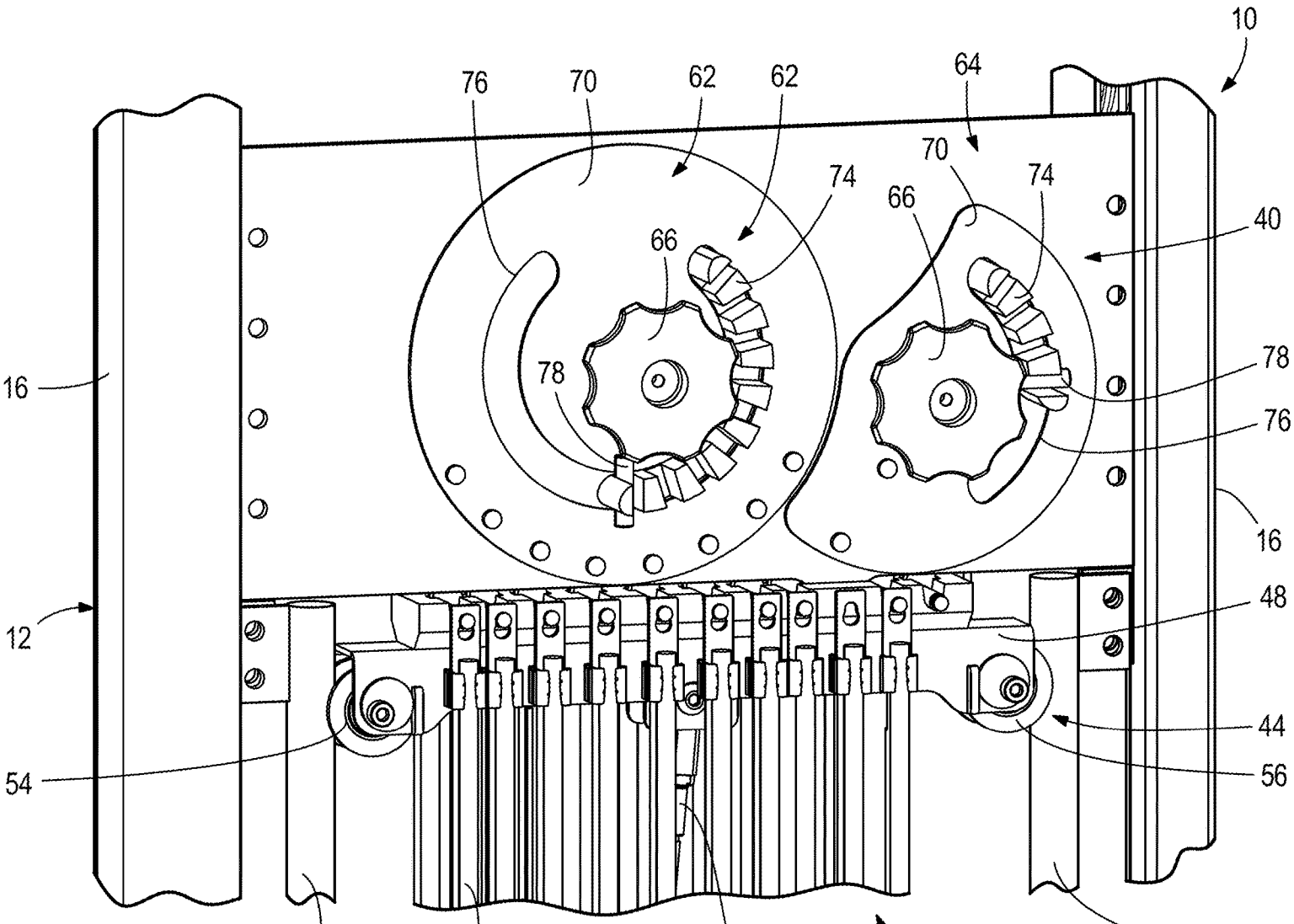
FIG. 3 is a front perspective view of a top portion of the exercise machine, showing a selector mechanism for adjusting an amount of resistance provided by the resistance mechanism.
Figure 4:
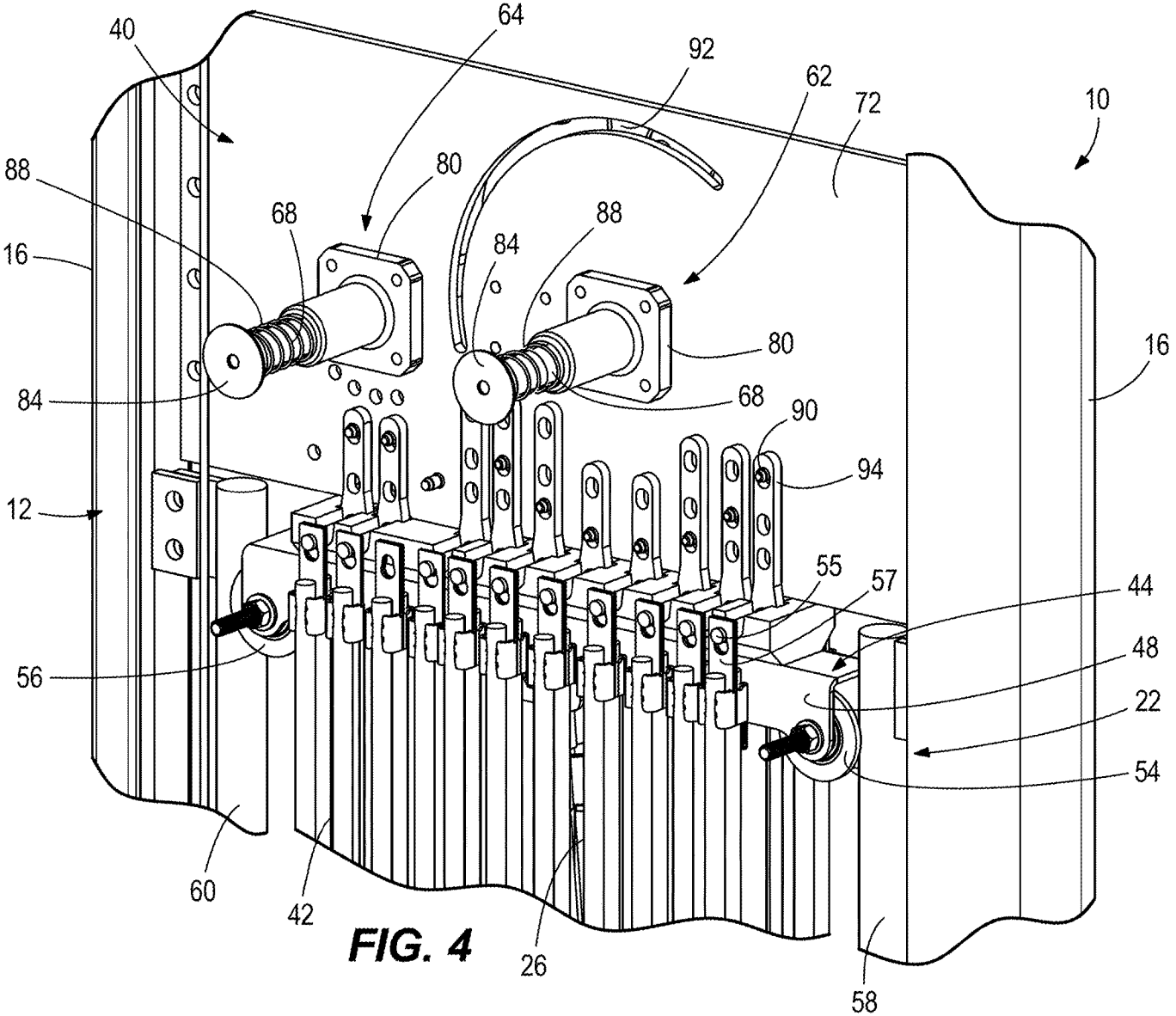
FIG. 4 is a rear perspective view of the selector mechanism.

The selector mechanism 40 is movable from a disengaged position to a plurality of engaged positions (e.g., FIG. 4) in each of which the selector mechanism 40 is engaged with different elastic resistance members 42, respectively. In each engaged position, the resistance mechanism 22 engages with a different number of elastic resistance members 42 and thus applies a different amount of resistance to operation of the pulley system 24. The selector mechanism 40 includes two selector linkages 62, 64, each having a handle 66 and a selector plate 70 that are rotatably fixed to a selector shaft 68. Referring to FIGS. 3 and 4, the selector plate 70 is located on the front of the exercise machine 10. The selector shaft 68 extends through the cross panel 72 to the back of the exercise machine 10. The cross panel 72 has a series of selector teeth 74 for each selector linkage 62, 64. The selector teeth 74 protrude outwardly from the front of the cross panel 72 into a corresponding arcuate slot 76 formed in the selector plate 70. As shown in FIG. 3, the selector plate 70 also has a selector bar 78 that extends across the arcuate slot 76 and is configured to seat in between adjacent selector teeth 74. Each position of the selector bar 78 between adjacent selector teeth 74 corresponds to a particular resistance setting, as will be further described herein below.

Referring to FIG. 4, the selector shafts 68 extend through support bearings 80 mounted on the rear of the cross panel 72. Each support bearing 80 has an inner mounting surface that is mounted to the cross panel 72 by for example fasteners and an outer end surface that faces away from the rear of the cross panel 72. The selector shaft 68 extends through the support bearing 80 and is rotatably supported therein. An end cap 84 is coupled to the outer end 86 of the selector shaft 68. A spring 88 is disposed on the selector shaft 68 between the outer end surface and the end cap 84. The spring 88 has a natural bias that pushes on the outer end surface of the support bearing 80 and on the end cap 84, thus tending to move the selector plate 70 towards the cross panel 72 until the selector bar 78 is seated between adjacent selector teeth 74, for example as shown in FIG. 3.

Figure 5:
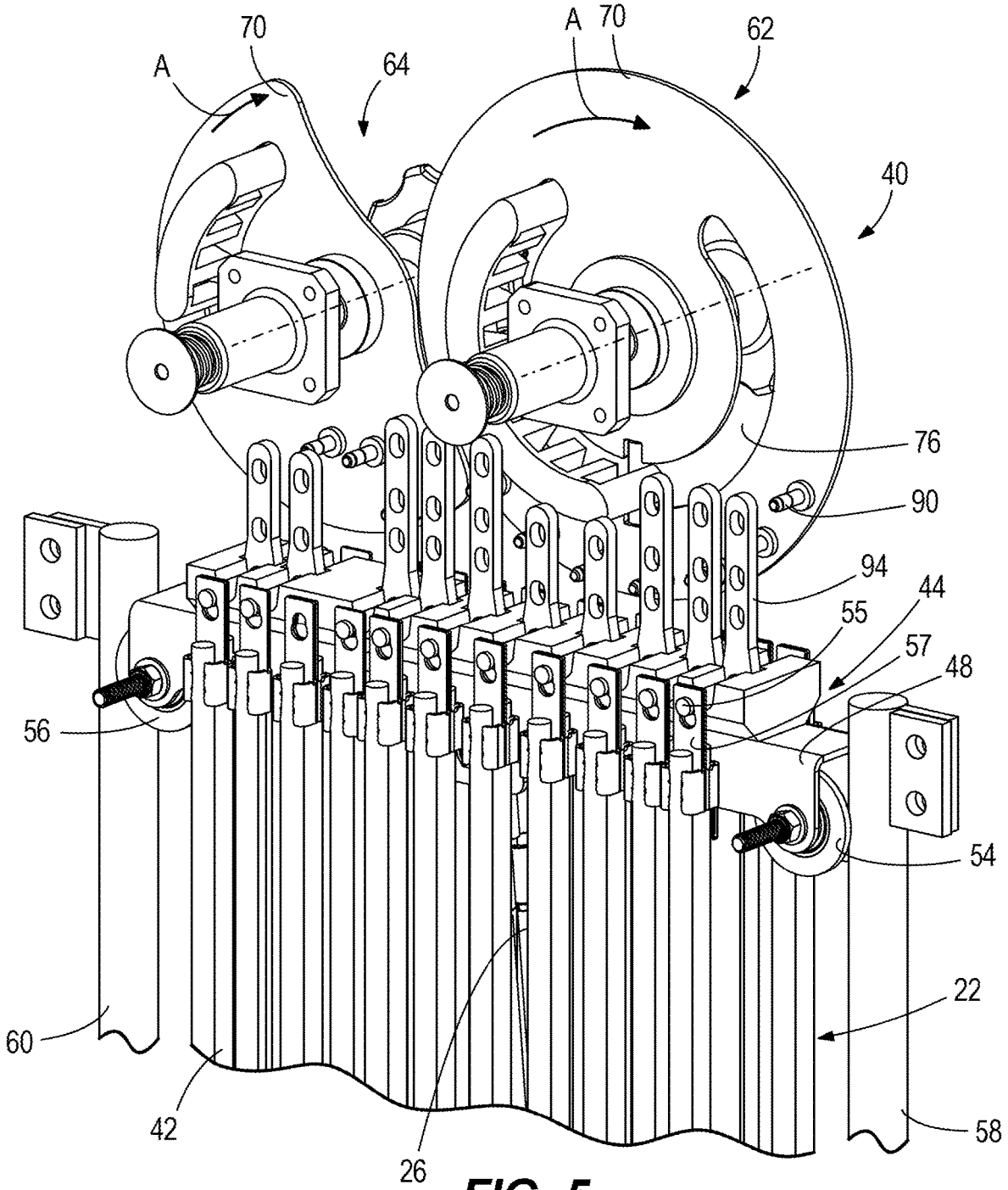
FIG. 5 is a view like FIG. 4, showing the resistance mechanism in a rest position and showing the selector mechanism being operated to change the amount of resistance.

Referring to FIGS. 4 and 5, each selector plate 70 also has a series of engagement fingers 90 that extend from the back of the selector plate 70 through an arcuate slot 92 in the cross panel 72. Referring to FIG. 4, the upper end 46 of each elastic resistance member 42 has an engagement tab 94 that is connected to and extends upwardly from the cross-pin 55. Each engagement tab 94 has one or more through-holes that are generally aligned with the arcuate slot 92 when the carriage 44 is in its rest position, shown in FIG. 1. The engagement tabs 94 are thus configured for engagement with at least one of the engagement fingers 90 extending through the arcuate slot 92, depending on a rotational position of the selector mechanism 40, as will be described further herein below.

The selector mechanism 40 is operable to adjust the amount of resistance provided by the resistance mechanism 22 by allowing the user to engage different numbers of elastic resistance members 42. Referring to FIGS. 3 and 4, each selector linkage 62, 64 of the selector mechanism 40 is normally biased by the springs 88 into engagement with the resistance mechanism 22. In particular, the springs 88 pushes the end cap 84 away from the outer end surface and thus pushes the engagement fingers 90 on the selector plate 70 through the arcuate slot 92 in the cross panel 72 and into a through-hole of certain ones of the engagement tabs 94 of the elastic resistance members 42, depending upon the rotational position of the selector plate 70. Referring to FIG. 5, to change the resistance, the operator manually grasps the respective handle 66 and pulls the handle away from the front of the cross panel 72. This disengages the engagement fingers 90 from the through-holes, against the bias of the spring 88. Movement of the selector plate 70 outwardly away from the front of the cross panel 72 also removes the selector bar 78 out from between the selector teeth 74, thus permitting rotation of the handle 66 and selector plate 70 about the axis of the selector shaft 68, as shown at arrows A. That is, to change the amount of resistance, the user rotates the handle 66 and associated selector shaft 68 and selector plate 70, which shifts the position of the engagement fingers 90 along the arcuate slot 92 and into alignment with different through-holes of the engagement tabs 94. Then, referring to FIG. 6, when the user releases the handle 66, the bias of the spring 88 forces the selector plate 70 back towards the cross panel 72. This forces the selector shaft 68 out of the support bearing 80 and causes the selector bar 78 to seat between the selector teeth 74, as well as the engagement fingers 90 to engage with the through-holes in the engagement tabs 94. Thereafter, referring to FIG. 7, operation of the pulley system 24 by the user during an exercise motion pulls downwardly on the carriage 44, as shown at arrow B. Downward movement of the carriage 44 is resisted by the elastic resistance members 42 that are engaged with the selector mechanism 40. As the pulley system 24 is released by the user, the elastic resistance members 42 naturally cause the carriage to retract back upwardly into the rest position shown in FIG. 1. Please see the above-incorporated U.S. patents for further description of similar suitable selector mechanisms.

Figure 6:
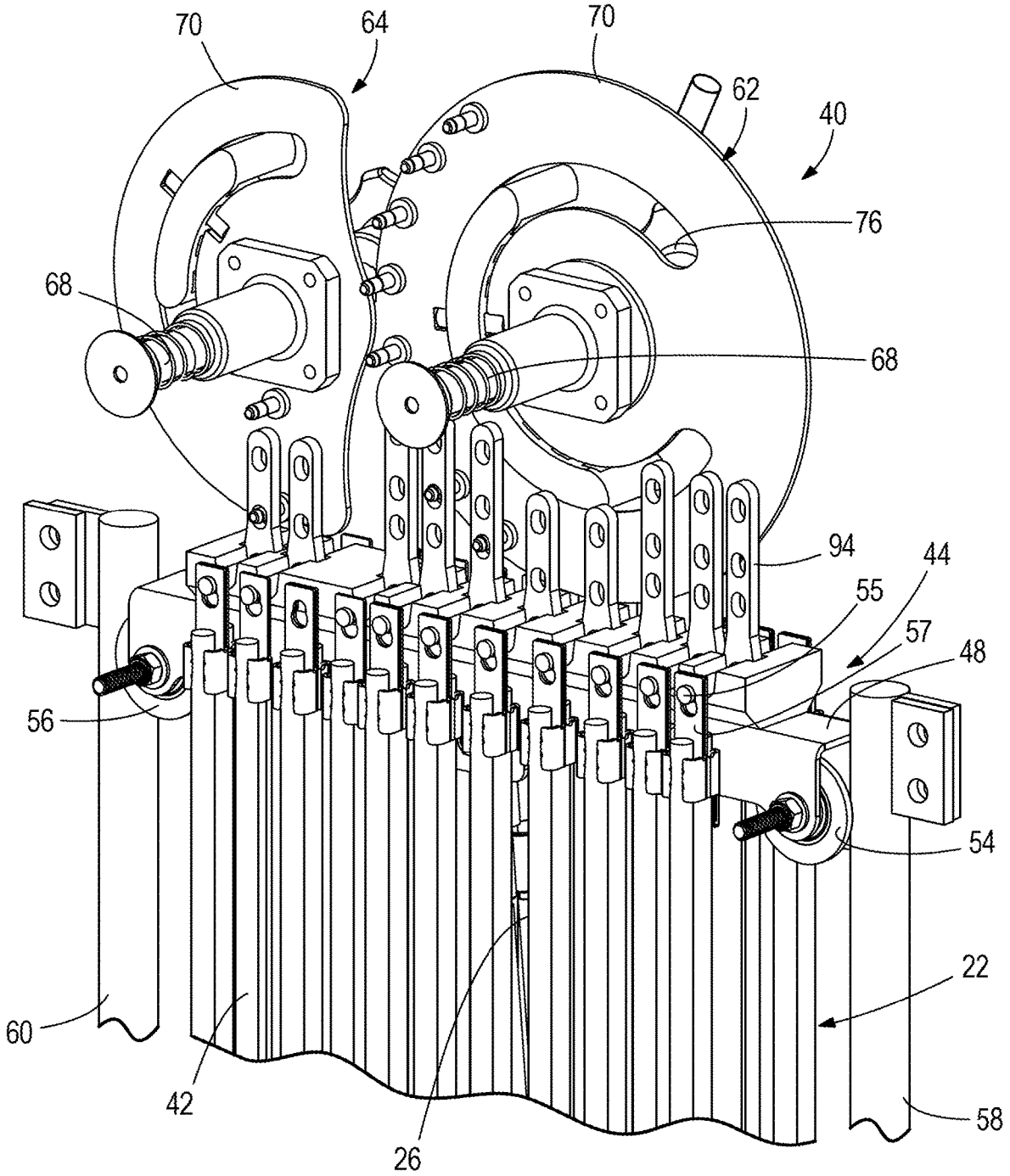
FIG. 6 is a view like FIG. 4, showing the selector mechanism after the amount of resistance has been changed.
Figure 7:
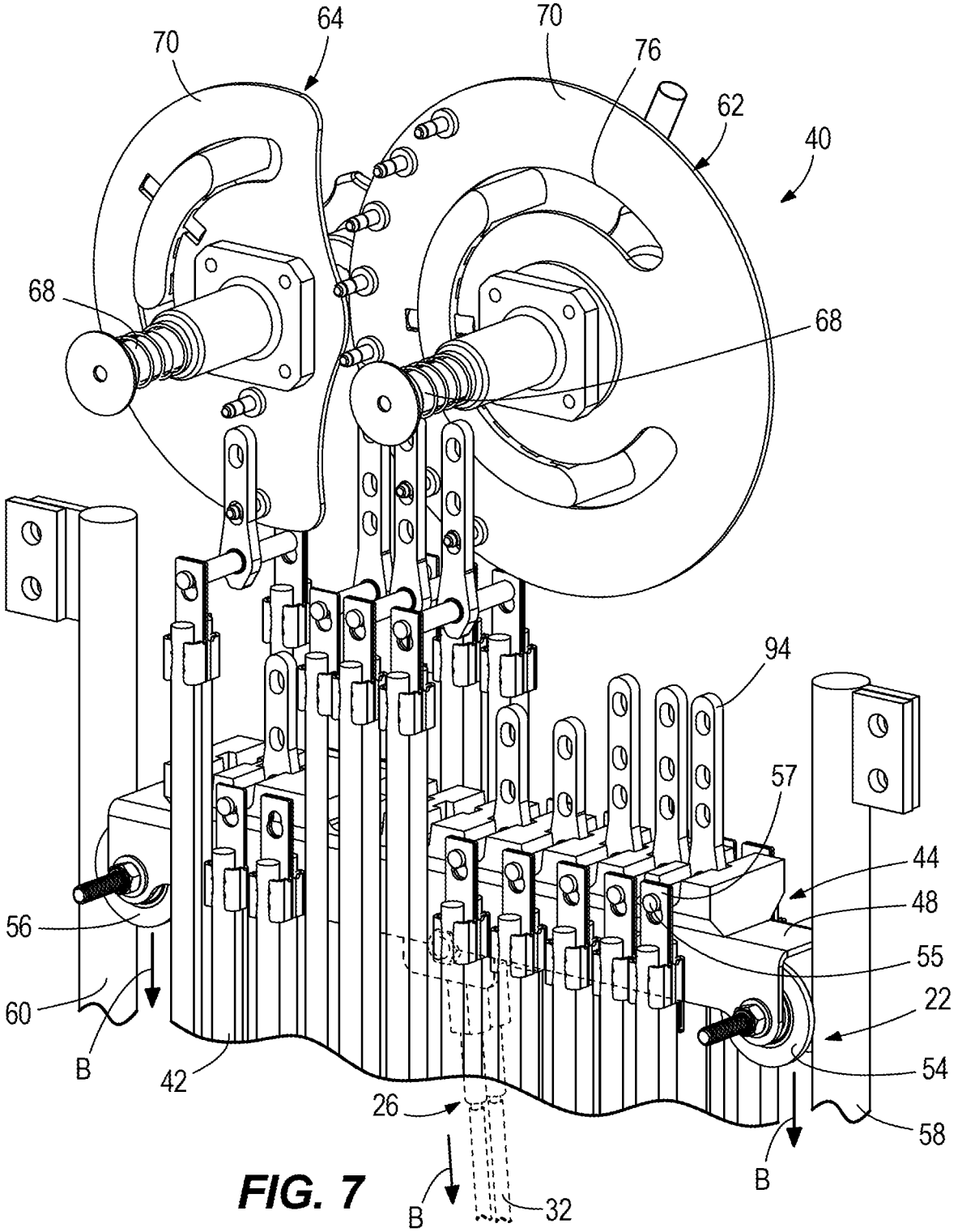
FIG. 7 is a view like FIG. 4, showing movement of the resistance mechanism upon initiation of the exercise motion by the user.
Figure 8:
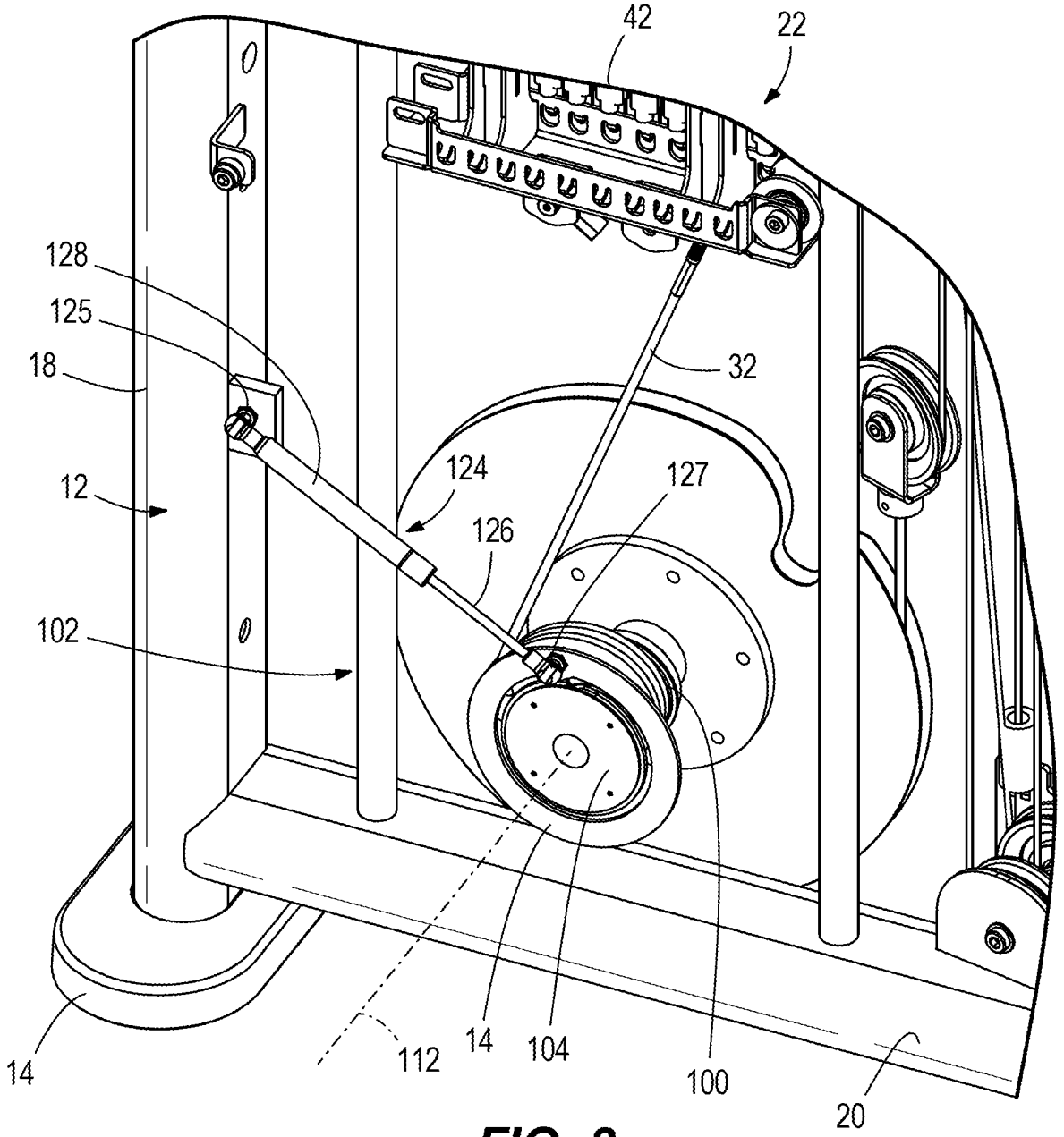
FIG. 8 is a detailed view of a dampening device for dampening movement of the resistance mechanism when a user suddenly releases the pulley system.
Figure 9:
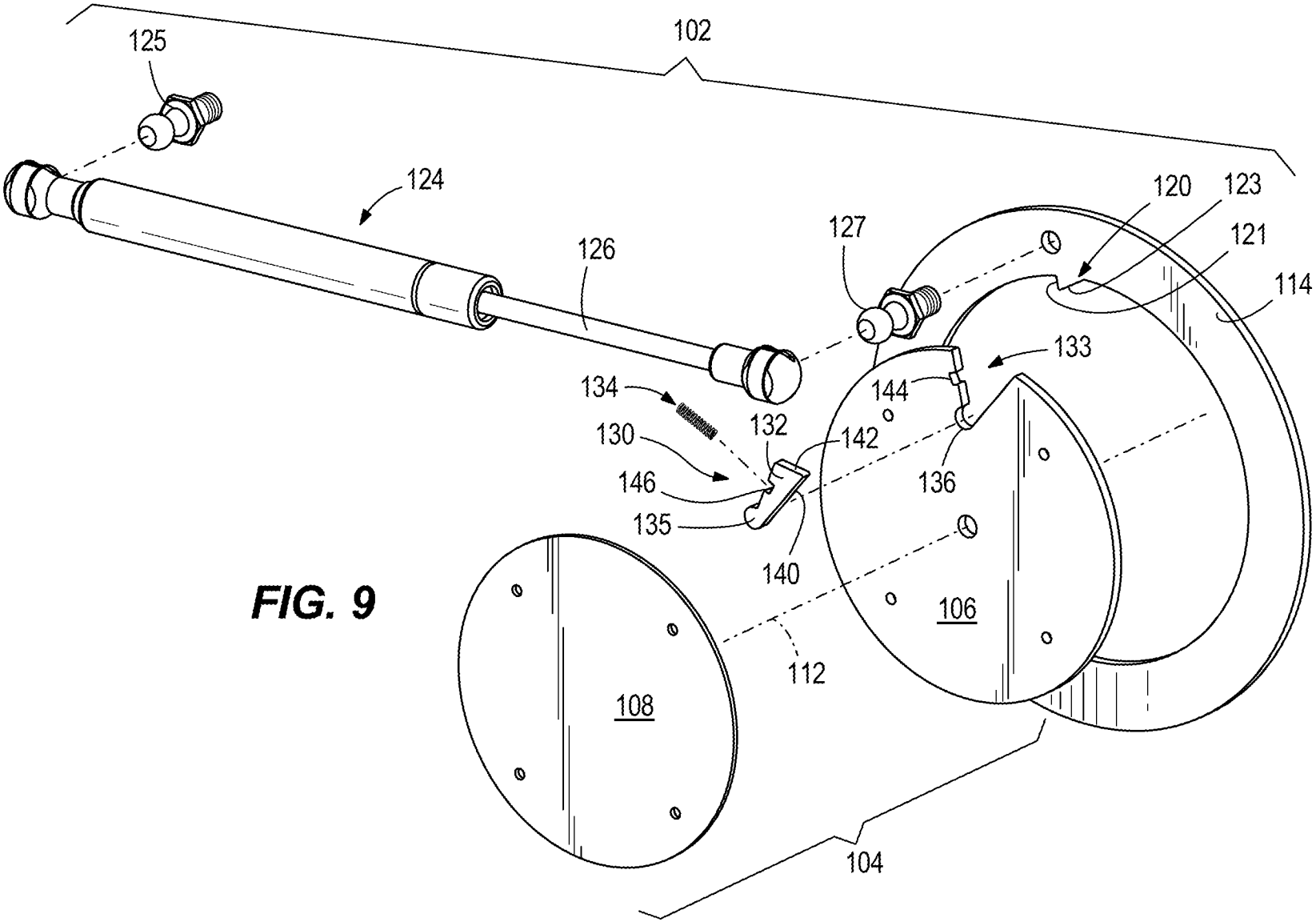
FIG. 9 is an exploded view of the dampening device.

FIG. 4 thus depicts the resistance mechanism 22 and selector mechanism 40 in a rest position. FIG. 5 depicts the selector mechanism 40 as it is manually operated by the user to change the amount of resistance provided by the resistance mechanism 22. Specifically, the user has grasped and pulled on the handles 66. Pulling on the handles 66 pulls the end cap 84 thus compressing the spring 88 against the outer end surface 82. This also pulls the selector plates 70 away from the front of the cross panel 72, unseating the selector bar 78 from the recesses between the selector teeth 74 and withdrawing the engagement fingers 90 from the through-holes in the engagement tabs 94. Thereafter, as shown at arrows A, the user rotates the handle 66, which rotates the selector shafts 68 and associated selector plates 70. Rotation of the selector plates 70 causes a different number or configuration of engagement fingers 90 to become aligned with a different number or configuration of through-holes in engagement tabs 94. Referring to FIG. 6, the user has manually released the handle 66, allowing the spring 88 to force the end cap 84 away from the outer end surface 82. This forces the selector plate 70 towards the front of the cross panel 72 and causes the selector bar 78 to seat within a recess between adjacent selector teeth 74. It also causes engagement between the engagement fingers and certain through-holes in engagement tabs 94, as shown in FIG. 6.

Thereafter, operation of the pulley system 24, for example pulling on one or more of the second ends 28*a*, 28*b*, 28*c* pulls downwardly on the carriage 44, as shown at arrows B, which causes the carriage 44 to travel downwardly as roller wheels 54, 56 rolls along vertical bars 58, 60. Thereafter, releasing the second ends 28*a*, 28*b*, 28*c* of the pulley system 24 allows the natural resiliency of the elastic resistance members 42 to pull the carriage 44 back towards the rest position, opposite the direction of arrows B.

As mentioned above, the resistance mechanism 22 and selector mechanism 40 that is shown and described can vary and for example can alternately be configured similar to one or more of the arrangements disclosed in the above-incorporated patents.

Through research and experimentation, the present inventor has determined that the exercise machine 10 described above would benefit from having a safety device that prevents the resistance mechanism 22 from quickly retracting the pulley system 24 when the pulley system 24 is suddenly released while in its active position. Suddenly releasing the pulley system 24 when the resistance mechanism 22 is in the active position can permit the elastic resistance members 42 to freely retract the pulley system 24 and carriage 44 with excessive force, potentially damaging the exercise machine 10 and creating a loud noise, which can be distracting or annoying to the user.

To overcome this drawback in the prior art, the present inventor has added a dampening device 102 to the exercise machine 10. FIGS. 8-10B depict one example of such a dampening device 102 according to the present disclosure, which in this example is operably connected to the pulley system 24 via the cam 100. In other examples, the dampening device 102 could be located elsewhere on the exercise machine, on the resistance mechanism 22 and/or the pulley system 24.

In the illustrated example, the dampening device 102 includes a hub 104 that is disposed on and rotates with the cam 100 as the user operates the pulley system 24. The exact configuration of the hub 104 can vary from what is shown. The hub 104 includes a base plate 106 and a cover plate 108 that are together attached to the cam 100 such that the center of the hub 104 is aligned with the center axis 112 of the cam 100. Thus, the cam 100 and hub 104 are concentrically aligned and rotate together as the user operates the pulley system 24. A damper plate 114 is located adjacent the hub 104. The damper plate 114 is concentrically aligned with the hub 104 and has an inner perimeter that surrounds and faces the outer perimeter of the hub 104. However, this example is not limiting and other types of damper plates 114 could be employed. The damper plate 114 also does not have to surround the outer perimeter of the hub 104 and does not have to be concentric therewith. The damper plate 114 has an engagement finger 120 that extend radially inwardly towards the hub 104, into an annular gap or space 122 between the outer perimeter of the hub and inner perimeter of the damper plate 114. The engagement finger 120 has a radially extending stop surface 121 and an opposite sloped cam surface 123. Thus, in the illustrated example, the engagement finger 120 has a generally triangular shaped profile when viewed from the side (as in FIG. 10B). The functionality of the engagement finger 120 will be further described herein below.

A dampening member 124 is attached to the damper plate 114 and to the supporting frame 12 and configured to resist movement of the damper plate 114 with respect to the hub 104, as will be further described herein below with respect to FIGS. 11-16. In this example, the dampening member 124 is a piston-cylinder device having a piston and piston rod combination 126 that reciprocates within a cylinder 128. This type of dampening member 124 is a conventional item that is commonly referred to as a gas spring or shock, which has a gas and/or spring and or hydraulic mechanism for resisting quick-action movement of the piston and piston rod combination 126 with respect to the cylinder 128. One suitable example is commercially available from Stabilus, model Stab-o-Shoc HD294214R. However other types of spring and/or gas and/or hydraulic mechanisms could be used; and in fact any other type of resistance member for suitably resisting quick movement of the damper plate 114 with respect to the hub 104 could be used. The dampening member 124 has a first end that is attached to the supporting frame 12 at a universal ball joint 125 and an opposite, second end that is attached to the damper plate 114 by another universal ball joint 127. The ball joints 125, 127 allow the dampening member 124 and damper plate 114 to work together such that clockwise rotation of the damper plate 114 (as viewed in FIG. 9) causes extension of the piston and piston rod combination 126 from the cylinder 128 and such that counter clockwise rotation of the damper plate 114 (as viewed in FIG. 9) causes retraction of the piston and piston rod combination 126 into the cylinder 128. It will be understood that extension/retraction of the dampening member 124 is permitted by pivoting movements at the respective ball joints 125, 127, which in turn allows the angular movement of the dampening member 124 with respect to the supporting frame 12. Extension and retraction of the piston and piston rod combination 126 is dampened or slowed by the above-noted spring or oil or gas force.

The dampening device 102 has an inertial switch 130 that causes the dampening device 102 to automatically dampen movement of the resistance mechanism 22 from the active position towards the rest position when the pulley system 24 is suddenly released. The inertial switch 130 includes a pawl 132 that is located in a recess 133 radially extending into the base plate 106 of the hub 104. The pawl 132 has a rounded pivot end 135 that is fitted within a radially inner groove 136 of the recess 133 such that the pawl 132 is pivotable/movable into and between an engagement position (FIG. 10B) in which the dampening device 102 engages the pulley system 24 and a disengaged position (FIG. 10A) in which the dampening device 102 is disengaged from the pulley system 24. The pawl 132 has a free end with an engagement side 140 and a sloped outer end surface 142, the functionality of which will be further described herein below. Once assembled with the base plate 106, the cover plate 108 covers the recess 133 and the pawl 132 and protects them from external interference.

Figure 10B:
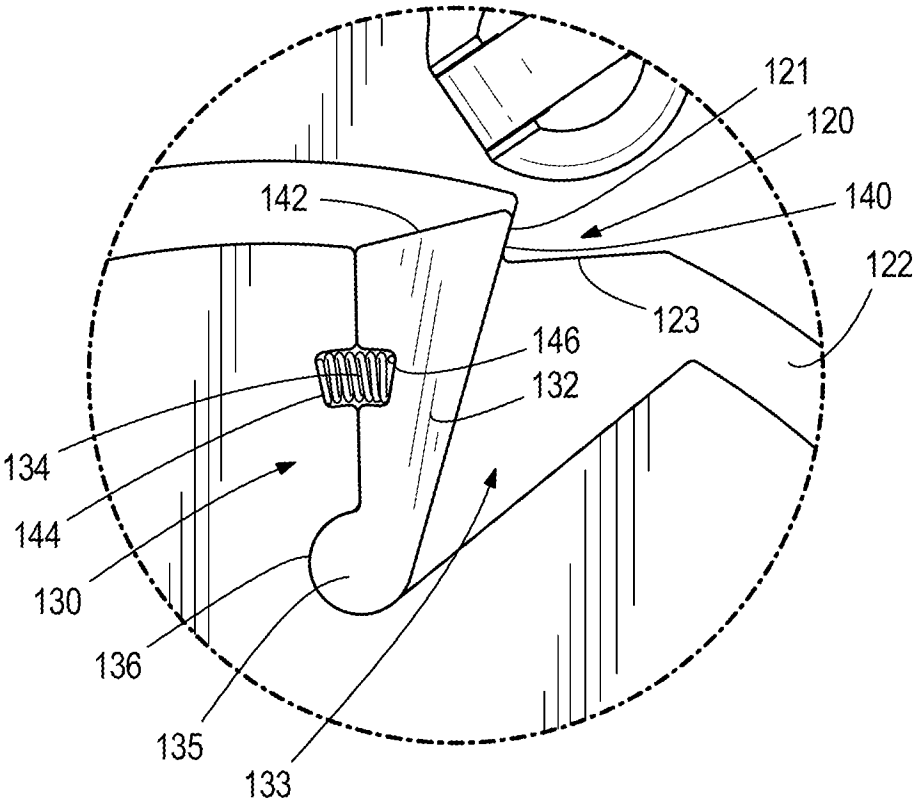
FIGS. 10A and 10B depict an inertial switch of the dampening device in open and closed positions.
Figure 10A:
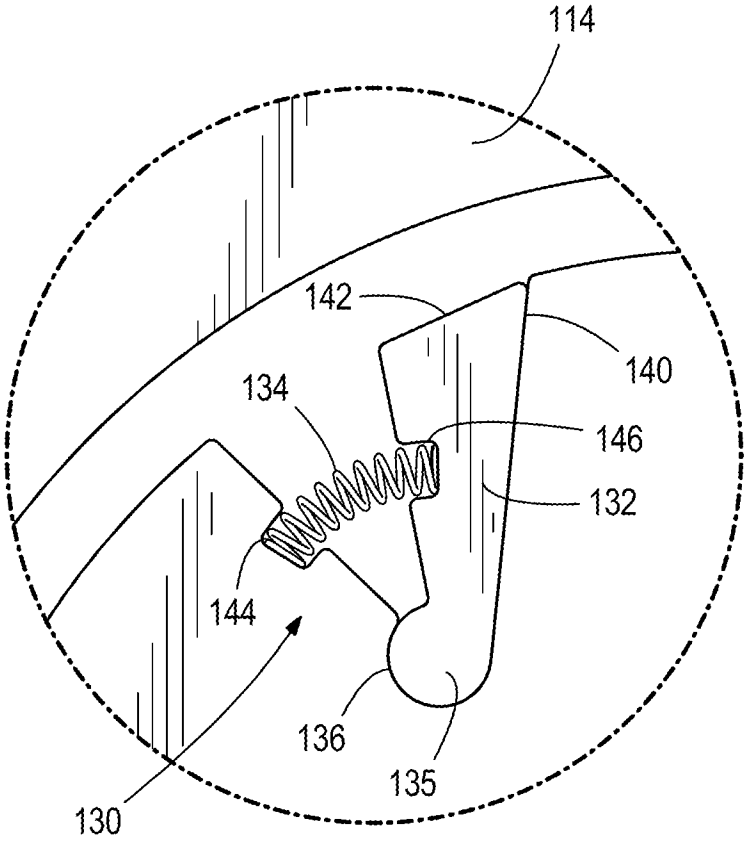

The inertial switch 130 further includes a spring 134, which in this example is a coil spring, that is engaged at opposite ends with a notch 144 extending from the recess 133 and a notch 146 formed in the pawl 132 between the pivot end 135 and the free end. The type and configuration of the spring 134 can vary from what is shown and described. The spring 134 tends to extend into the position shown in FIG. 10A, and provides a spring force that biases the pawl 132 into the disengaged position shown in FIG. 10A. As further explained herein below, suddenly releasing the pulley system 24 when the resistance mechanism 22 is in the active position allows the resistance mechanism 22 to quickly move back towards the inactive position, which in turn quickly rotates the cam 100 and the hub 104 and causes an inertial force on the inertial switch 130 to increase to a level that is sufficient to move the pawl 132 into the engagement position shown in FIG. 10B, against the spring force. That is, suddenly releasing the pulley system 24 causes the cam 100 and hub 104 to quickly rotate. The inertial switch 130 is thus caused to rotate as well. When the inertial switch 103 is subjected to an inertial force that is greater than the spring force, the spring 134 is compressed by the pawl 132 as the pawl 132 is moved by the inertial force into the engaged position. As shown in FIGS. 10A and 10B, the pawl extends out of the recess 133 in the extended position (FIG. 10B) and is retracted back into the recess 133 (FIG. 10A) in the retracted position.

Figure 11:
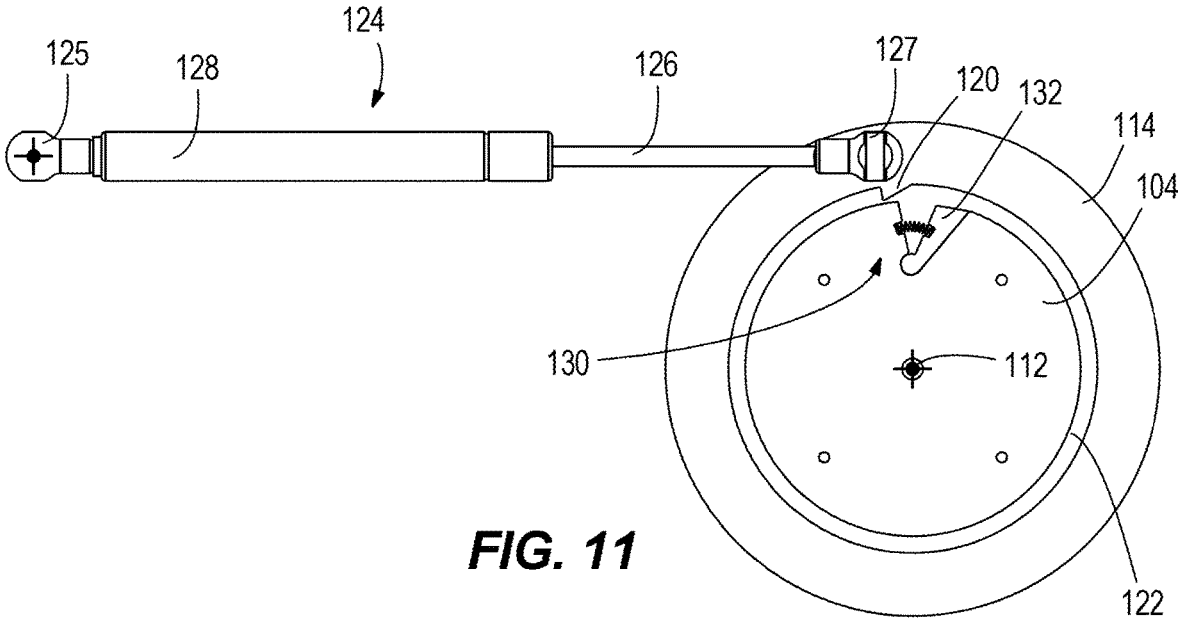
FIGS. 11 and 12 show positional states of the dampening device during normal operation of the exercise machine.
Figure 12:
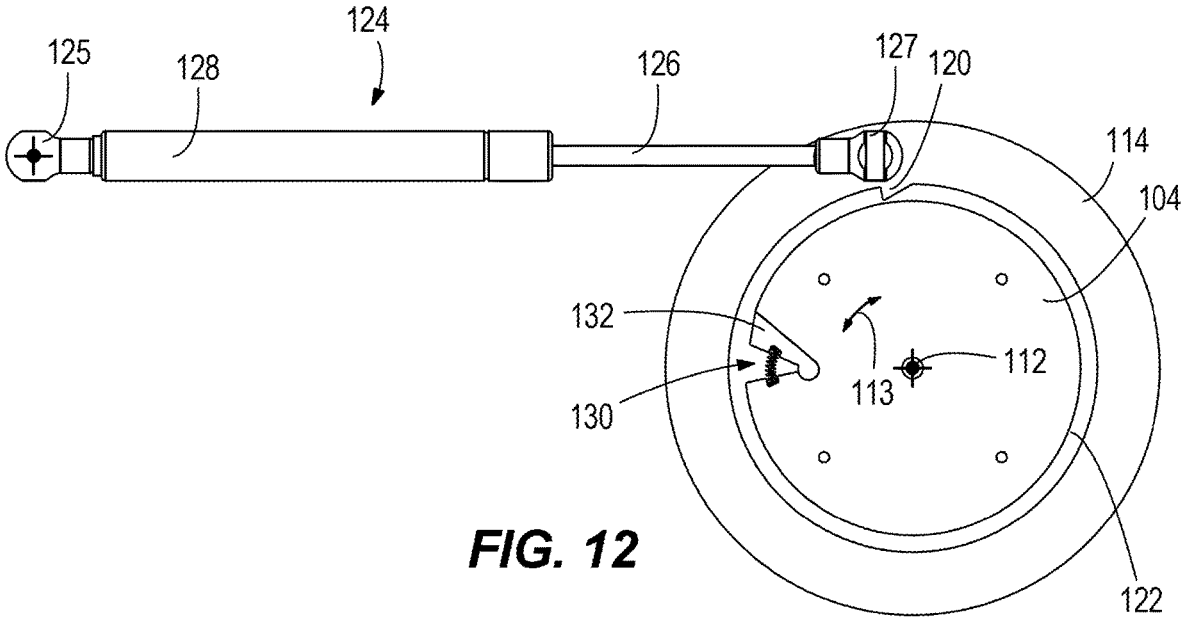

Referring now to FIGS. 11-16, operation and functionality of the dampening device 102 will be explained. FIGS. 11 and 12 depict the dampening device 102 during normal operation of the exercise machine 10. As the user moves the pulley system 24 back and forth and causes the resistance mechanism 22 to raise and lower into and out of the active position, the cam 100 (FIG. 8) and hub 104 are rotated back and forth about the center axis 112 as shown at arrow 113. This causes movement of the inertial switch 130 about the axis 112, as shown in FIGS. 11 and 12. The inertial force on the inertial switch is less than the spring force and thus the pawl 132 is retained in the retracted position shown in FIGS. 11 and 12. The damper plate 114 and dampening member 124 remain stationary as the hub 104 and inertial switch 130 move back and forth.

Figure 13:
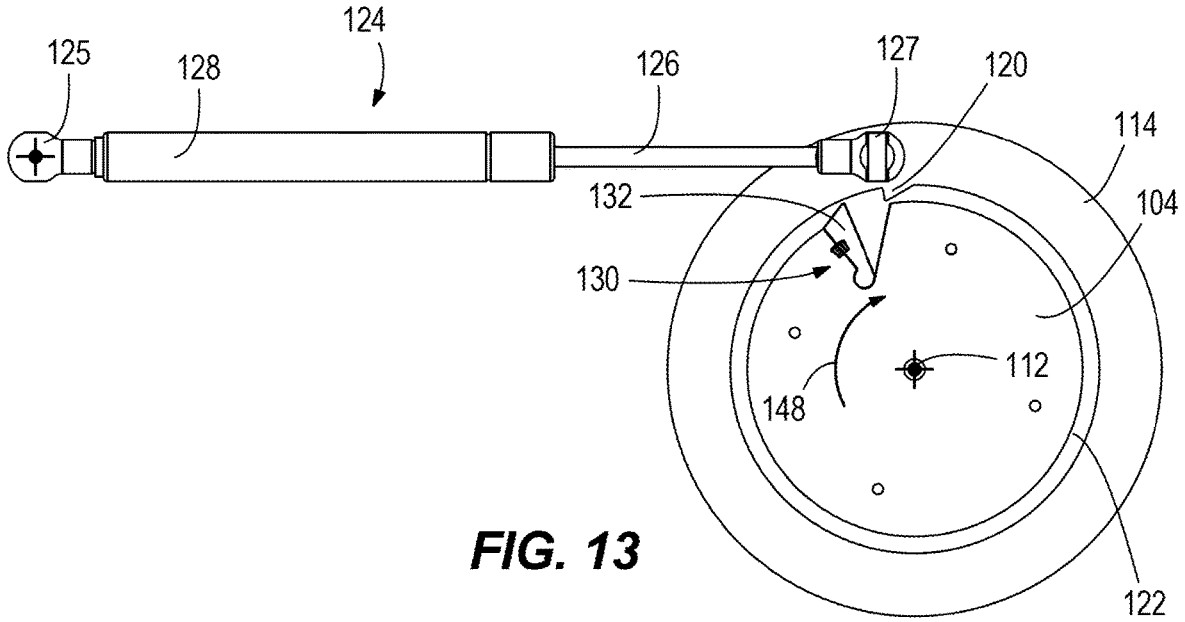
FIGS. 13-16 show a sequence of positional states of the dampening device before, during, and after the user suddenly releases the pulley system.
Figure 14:
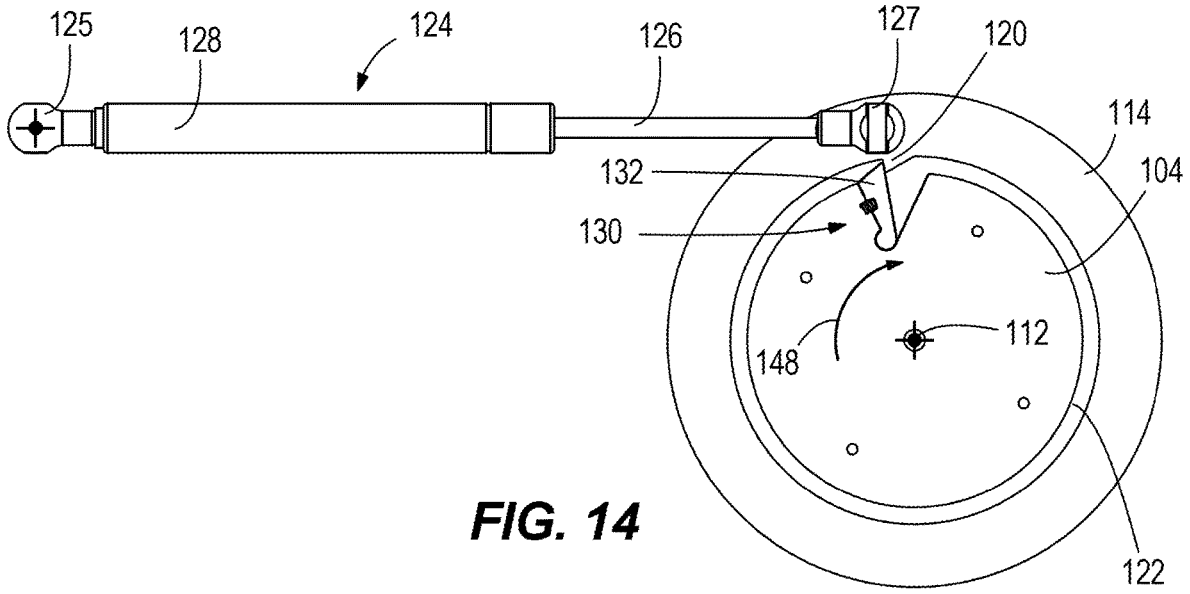
Figure 15:
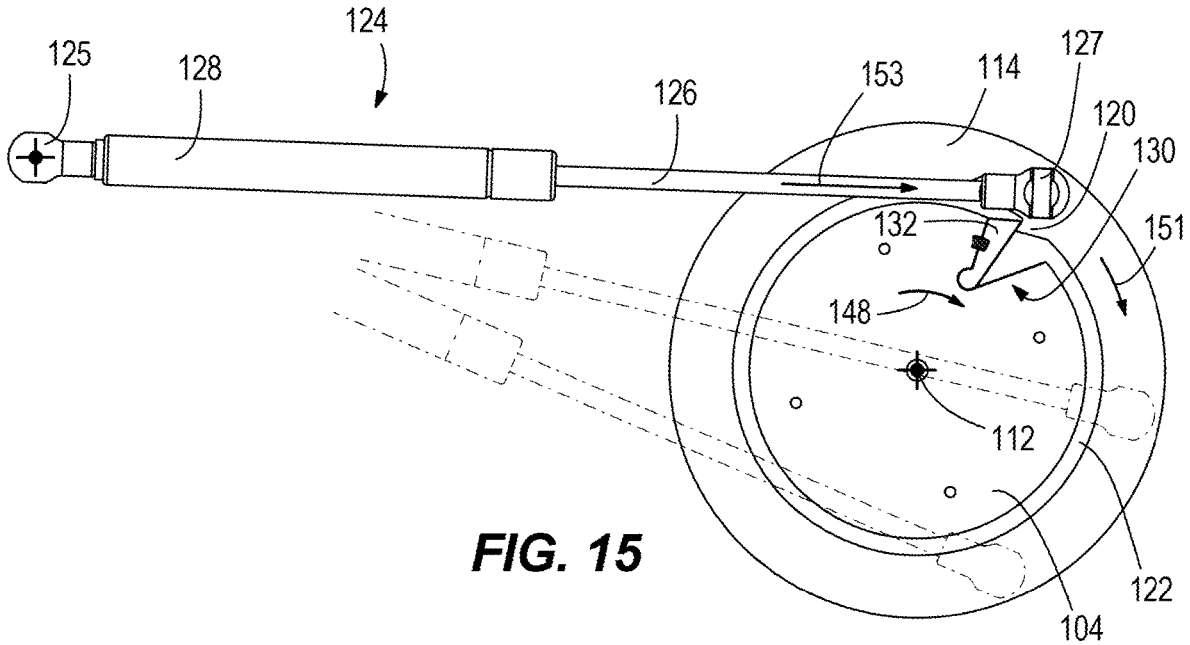

FIGS. 13-15 depict the dampening device 102 when the user suddenly releases the pulley system 24 with the resistance mechanism 22 in the active position. Upon release, the resistance mechanism 22 quickly moves from the active position towards the rest position. This causes the cam 100 and associated hub 104 to rapidly rotate in the direction of arrow 148. As described above, rotation of the hub 104 generates an inertial force on the inertial switch 130. If the speed of rotation is fast enough to generate an inertial force that is greater than the spring force, the inertial force will cause the pawl 132 to move from the disengaged position to the engagement position shown in FIGS. 13-15. Then, as the hub 104 rotates in the direction of the arrow 148, the engagement side 140 of the pawl 132 engages the stop surface 121 of the engagement finger 120, which operably connects the damper plate 114 and dampening member 124 to the hub 104 and thus to the pulley system 24 and resistance mechanism 22 via the cam 100. The damper plate 114 is caused to rotate with the hub 104, see arrow 151, and the dampening member 124 is thus causes to extend, see arrow 153, by the force of the resistance mechanism 22 as it moves into its rest position. As the dampening member 124 extends, it dampens (slows) movement of the resistance mechanism 22, thus advantageously allowing the resistance member 22 to safely return to the rest position without damage thereto and without causing a loud noise or other disruption to the user.

Figure 16:
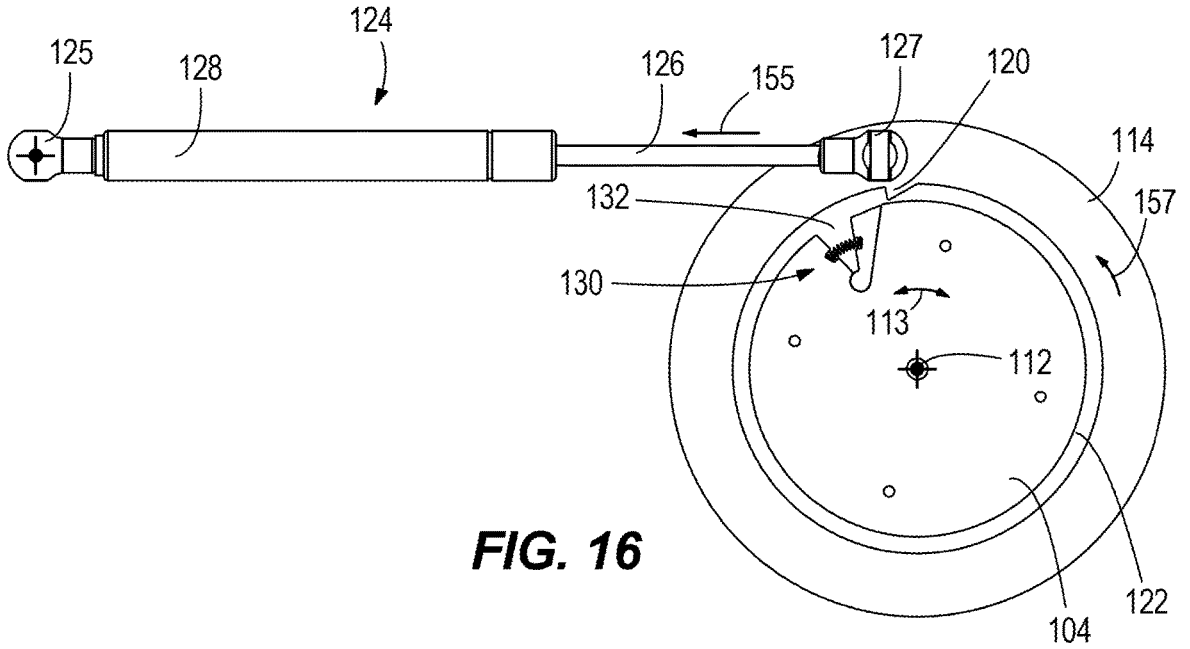

Once the inertial force on the inertial switch 130 returns to an amount that is below the spring force, the spring 134 moves the pawl 132 back into the disengaged position shown in FIG. 16 and the hub 104 (and associated cam 100, pulley system 24, resistance mechanism 22) is again free to move with respect to the damper plate 114. The piston and piston rod combination 126 is also free to retract back into the retracted position with respect to the cylinder 128, see arrow 155, thus moving the damper plate 114 back into its original position, as shown in FIG. 16 at arrow 157. In cases where the spring 134 fails, the sloped cam surface 123 of the engagement finger 120 and the sloped outer end surface 142 of the free end of the pawl 132 are advantageously configured to engage each other and provide a camming force that forces the pawl 132 into the disengaged position.

In the present description, certain terms have been used for brevity, clearness and understanding. No unnecessary limitations are to be implied therefrom beyond the requirement of the prior art because such terms are used for descriptive purposes only and are intended to be broadly construed. The different systems, methods and apparatuses described herein may be used alone or in combination with other systems, methods and apparatuses. Various equivalents, alternatives and modifications are possible within the scope of the appended claims.

What is claimed is:

1. An exercise machine comprising:

a resistance mechanism that is movable with respect to a stationary frame into and between a rest position and an active position;

a pulley system coupled to the resistance mechanism and being operable by a user performing an exercise motion, wherein operation of the pulley system moves the resistance mechanism from the rest position to the active position, against a resistance force from the resistance mechanism, and wherein releasing the pulley system allows the resistance force to automatically move the resistance mechanism back towards the rest position;

a dampening device comprising an inertial switch that causes the dampening device to automatically dampen movement of the resistance mechanism from the active position towards the rest position when the pulley system is suddenly released;

wherein the pulley system comprises a pulley cable and a cam about which the pulley cable extends such that operation of the pulley system causes rotation of the cam, and such that when the user suddenly releases the pulley system the cam is rotated by the pulley cable;

wherein the inertial switch is coupled to the cam such that rotation of the cam causes rotation of the inertial switch; and a hub that rotates along with the cam, wherein the inertial switch is located on an outer perimeter of the hub;

wherein the inertial switch further comprises a pawl that is movable into and between an engagement position in which the dampening device engages with the pulley system and a disengaged position in which the dampening device is disengaged from the pulley system; and wherein the inertial switch further comprises a spring providing a spring force that biases the pawl into the disengaged position, wherein suddenly releasing the pulley system when the resistance mechanism is in the active position causes an inertial force on the inertial switch sufficient to move the pawl into the engagement position against the spring force; and wherein the dampening device further comprises a damper plate that is coupled to the dampening device, wherein in the engagement position the pawl engages with the damper plate so that the hub and damper plate rotate together and in the disengaged position the pawl is disengaged from the damper plate so that the hub rotates with respect to the damper plate.

2. The exercise machine according to claim 1, further comprising a dampening member that is coupled to the damper plate.

3. The exercise machine according to claim 2, wherein the dampening member comprises a piston-cylinder device that slows the movement of the resistance mechanism from the active position towards the rest position when the pawl engages with the damper plate.

4. The exercise machine according to claim 3, wherein the piston-cylinder device has a first end that is coupled to the stationary frame and an opposite second end that is coupled to the damper plate such that rotation of the damper plate in a first direction causes the piston-cylinder to extend and such that rotation of the damper plate in an opposite, second direction causes the piston-cylinder to retract.

5. The exercise machine according to claim 4, wherein when the spring force biases the pawl into the disengaged position, the piston-cylinder device is configured to automatically retract and rotate the damper plate back toward an original position of the damper plate.

6. The exercise machine according to claim 1, wherein the damper plate is concentrically aligned with the hub.

7. The exercise machine according to claim 6, wherein the damper plate comprises an engagement finger that extends radially inwardly towards the hub and is engaged by the pawl when the pawl is in the engagement position and the hub is rotated with respect to the damper plate.

8. An exercise machine comprising:

a resistance mechanism that is movable with respect to a stationary frame into and between a rest position and an active position;

a pulley system coupled to the resistance mechanism and being operable by a user performing an exercise motion, wherein operation of the pulley system moves the resistance mechanism from the rest position to the active position, against a resistance force from the resistance mechanism, and wherein releasing the pulley system allows the resistance force to automatically move the resistance mechanism back towards the rest position; and a dampening device configured to automatically slow movement of the resistance mechanism from the active position to towards the rest position when the pulley system is released; wherein the dampening device comprises a piston-cylinder device and an inertial switch, the dampening device being configured to automatically slow the movement of the resistance mechanism from the active position towards the rest position depending upon a positional state of the inertial switch;

wherein the inertial switch comprises a pawl that is movable into and between an engagement position in which the piston-cylinder device slows the movement of the resistance mechanism and a disengaged position in which the piston-cylinder device does not slow the movement of the resistance mechanism.

9. The exercise machine according to claim 8, wherein the inertial switch further comprises a spring providing a spring force that biases the pawl into the disengaged position, and wherein suddenly releasing the pulley system when the resistance mechanism is in the active position causes an inertial force on the inertial switch sufficient to move the pawl into the engagement position, against the spring force.

10. The exercise machine according to claim 9, wherein the pulley system comprises a pulley cable and a cam about which the pulley cable extends such that operation of the pulley system causes rotation of the cam, and such that suddenly releasing the pulley system rotates the cam; wherein the inertial switch is coupled to the cam such that rotation of the cam causes rotation of the inertial switch.

11. The exercise machine according to claim 8, wherein the pulley system comprises a pulley cable and a cam about which the pulley cable extends such that operation of the pulley system causes rotation of the cam, and such that when the user suddenly releases the pulley system the cam is rotated by the pulley cable; and wherein the inertial switch is coupled to the cam such that rotation of the cam causes rotation of the inertial switch.

12. The exercise machine according to claim 11, further comprising a hub that rotates along with the cam, wherein the inertial switch is located on an outer perimeter of the hub.

13. The exercise machine according to claim 8, wherein the resistance mechanism comprises a plurality of elastic resistance members that are supported by a carriage.

14. An exercise machine comprising:

a resistance mechanism that is movable with respect to a stationary frame into and between a rest position and an active position, the resistance mechanism comprising a plurality of elastic resistance members that are supported by a carriage;

a pulley system coupled to the resistance mechanism and being operable by a user performing an exercise motion, wherein operation of the pulley system moves the resistance mechanism from the rest position to the active position, against a resistance force from the resistance mechanism, and wherein releasing the pulley system allows the resistance force to automatically move the resistance mechanism back towards the rest position; and a dampening device comprising an inertial switch that causes the dampening device to automatically dampen movement of the resistance mechanism from the active position towards the rest position when the user suddenly releases the pulley system, wherein the dampening device further comprises a piston-cylinder device that slows the movement of the resistance mechanism from the active position towards the rest position depending upon a positional state of the inertial switch;

wherein the pulley system comprises a pulley cable and a cam about which the pulley cable extends such that operation of the pulley system causes rotation of the cam, and such that when the user suddenly releases the pulley system the cam is rotated by the pulley cable; and wherein the inertial switch is coupled to the cam such that rotation of the cam causes rotation of the inertial switch.

15. The exercise machine according to claim 14, further comprising a hub that rotates along with the cam, wherein the inertial switch is located on an outer perimeter of the hub, and wherein the inertial switch comprises a pawl that is movable into and between an engagement position in which the dampening device engages with the pulley system and a disengaged position in which the dampening device is disengaged from the pulley system.

16. An exercise machine comprising:

a resistance mechanism that is movable with respect to a stationary frame into and between a rest position and an active position;

a pulley system coupled to the resistance mechanism and being operable by a user performing an exercise motion, wherein operation of the pulley system moves the resistance mechanism from the rest position to the active position, against a resistance force from the resistance mechanism, and wherein releasing the pulley system allows the resistance force to automatically move the resistance mechanism back towards the rest position;

a dampening device comprising an inertial switch that causes the dampening device to automatically dampen movement of the resistance mechanism from the active position towards the rest position when the pulley system is suddenly released;

wherein the pulley system comprises a pulley cable and a cam about which the pulley cable extends such that operation of the pulley system causes rotation of the cam, and such that when the user suddenly releases the pulley system the cam is rotated by the pulley cable;

wherein the inertial switch is coupled to the cam such that rotation of the cam causes rotation of the inertial switch; and a hub that rotates along with the cam, wherein the inertial switch is located on an outer perimeter of the hub;

wherein the inertial switch further comprises a pawl that is movable into and between an engagement position in which the dampening device engages with the pulley system and a disengaged position in which the dampening device is disengaged from the pulley system; and wherein in the engagement position, the pawl extends out of a recess in the hub and wherein in the disengaged position the pawl is retracted in the recess.

* * * * *